US008322156B2

(12) United States Patent
Searle

(10) Patent No.: US 8,322,156 B2
(45) Date of Patent: Dec. 4, 2012

(54) EVAPORATIVE COOLING DEVICE FOR COOLING WATER OR OTHER LIQUIDS AND A COOLING GARMENT INCORPORATING THE SAME

(75) Inventor: Matthew Searle, Bruton Somerset (GB)

(73) Assignee: BCB International Ltd. (GB)

( * ) Notice: Subject to any disclaimer, the term of this patent is extended or adjusted under 35 U.S.C. 154(b) by 744 days.

(21) Appl. No.: 12/374,253

(22) PCT Filed: Jul. 23, 2007

(86) PCT No.: PCT/GB2007/002804

§ 371 (c)(1),
(2), (4) Date: Sep. 21, 2009

(87) PCT Pub. No.: WO2008/009979

PCT Pub. Date: Jan. 24, 2008

(65) Prior Publication Data

US 2010/0101253 A1 Apr. 29, 2010

(30) Foreign Application Priority Data

| | | |
|---|---|---|
| Jul. 21, 2006 | (GB) | 0614551.0 |
| Aug. 2, 2006 | (GB) | 0615350.6 |
| Sep. 7, 2006 | (GB) | 0617546.7 |
| Feb. 12, 2007 | (GB) | 0702494.6 |
| Apr. 25, 2007 | (GB) | 0707971.8 |
| May 17, 2007 | (GB) | 0709490.7 |

(51) Int. Cl.
*F25D 23/12* (2006.01)

(52) U.S. Cl. ..... 62/259.3; 62/259.4; 62/315

(58) Field of Classification Search ..... 62/121, 62/259.3, 259.4, 314, 315; 165/104.26; 2/69; 261/104.2, 154, 28

See application file for complete search history.

(56) References Cited

U.S. PATENT DOCUMENTS

| | | | | |
|---|---|---|---|---|
| 4,722,099 | A * | 2/1988 | Kratz | 2/79 |
| 5,180,361 | A * | 1/1993 | Moore et al. | 602/18 |
| 5,269,369 | A * | 12/1993 | Faghri | 607/104 |
| 5,437,612 | A * | 8/1995 | Moore et al. | 602/18 |
| 5,603,375 | A * | 2/1997 | Salt | 165/104.26 |
| 6,048,091 | A * | 4/2000 | McIntyre et al. | 374/54 |
| 6,090,085 | A * | 7/2000 | Mehl et al. | 604/291 |

(Continued)

*Primary Examiner* — Mohammad Ali

(74) *Attorney, Agent, or Firm* — Katten Muchin Rosenman LLP

(57) ABSTRACT

An evaporative cooling device (40) is disclosed for cooling water or other liquids comprising a vessel (50) adapted to receive water or another liquid, said vessel comprising a vessel wall (53, 54, 55), an outer layer (90) of absorbent material and a wick (85) extending through said vessel wall, such that said wick is positioned to contact said water or other liquid within the vessel and is adapted to transport a portion of said water or other liquid through the wall by capillary action to said absorbent material, said wick being substantially impermeable to gas or vapor, so that the cooling device (40) can be connected in-line in an hydration system of the kind comprising a reservoir (12) and a drinking tube (32). Water or other liquid transported from within the vessel to the outer layer by said wick is absorbed by the absorbent material, from which it evaporates, the latent heat required for such evaporation being removed from the water or other liquid disposed within the vessel as sensible heat through the vessel wall, thereby cooling such water or other liquid. In some embodiments, the cooling device (40) may be fan-assisted. Also disclosed is a cooling garment comprising a garment portion that is adapted to be worn by a user and an evaporative cooling device (40) for cooling water or other liquids that are circulated through integrant channels or tubes provided in the garment.

25 Claims, 10 Drawing Sheets

U.S. PATENT DOCUMENTS

| | | | | |
|---|---|---|---|---|
| 6,125,645 | A * | 10/2000 | Horn | 62/259.3 |
| 6,189,327 | B1 * | 2/2001 | Strauss et al. | 62/259.3 |
| 6,233,737 | B1 * | 5/2001 | Ditchfield et al. | 2/2.5 |
| 2001/0003907 | A1 * | 6/2001 | Siman-Tov et al. | 62/259.3 |
| 2002/0170309 | A1 * | 11/2002 | Strauss | 62/314 |
| 2003/0092544 | A1 * | 5/2003 | Reed | 482/105 |
| 2003/0152375 | A1 * | 8/2003 | Schneiderbauer | 392/395 |
| 2004/0058072 | A1 * | 3/2004 | Rearick et al. | 427/324 |
| 2005/0246826 | A1 * | 11/2005 | McCarter et al. | 2/458 |
| 2006/0170121 | A1 * | 8/2006 | French et al. | 261/94 |

* cited by examiner

FIG. 3
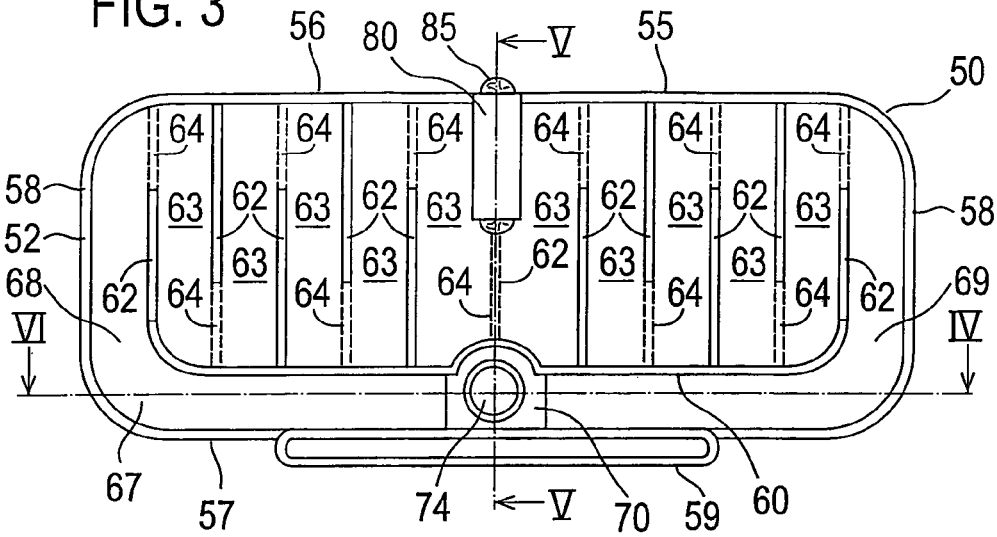
FIG. 4
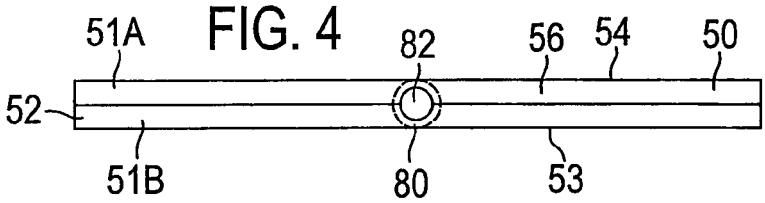
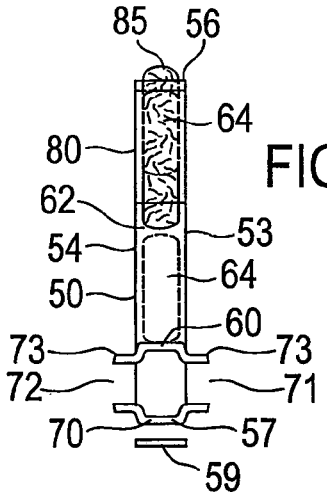
FIG. 5
FIG. 6
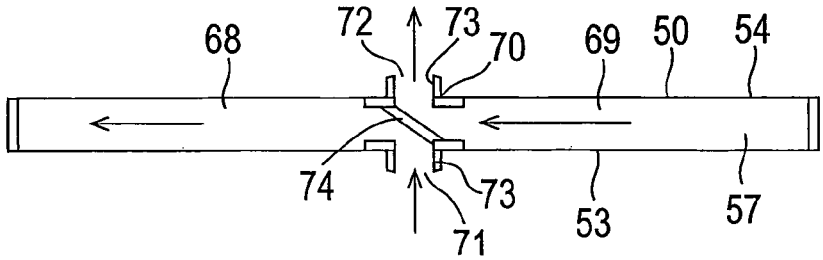

EVAPORATIVE COOLING DEVICE FOR COOLING WATER OR OTHER LIQUIDS AND A COOLING GARMENT INCORPORATING THE SAME

CROSS REFERENCE TO RELATED APPLICATIONS

The present invention claims priority to British Application Nos. GB0614551.0, filed Jul. 21, 2006, GB0615350.6, filed Aug. 2, 2006, GB0617546.7, filed Sep. 7, 2006, GB0702494.6, filed Feb. 12, 2007, GB0707971.8, filed Apr. 25, 2007, and GB07109490.7, filed May 17, 2007, the entire contents and disclosure of which is hereby incorporated by reference.

The present invention relates to an evaporative cooling device for cooling water or other liquids, and has particular reference to such a cooling device for use in cooling drinking water or other potable liquids. The invention also comprehends a cooling garment that incorporates an evaporative cooling device according to the invention and is adapted to supply cooled drinking water or other liquids.

In hot climates, drinking water can quickly heat up to unpalatable temperatures. If insufficient liquids are imbibed, then dehydration may ensue. There is a requirement therefore to provide drinking water or other liquids at an acceptable temperature, which is generally considered to be about 10-12° C. below ambient temperature.

There is also a requirement for portability. Hikers, cyclists and other people carrying out outdoor activities generally carry drinking water on their person. A typical hydration system of the kind well known in the art which incorporates a flexible reservoir or bladder and a drinking tube stores up to 3 L of water and is generally carried on the user's back. Means for cooling water supplied from such an hydration system should not add substantially to the weight of such equipment. For this reason, conventional refrigerators are generally unpractical and, further, require large amounts of power.

Self-cooling beverage containers have been used since ancient times and are well-known in the art. In some such containers, a portion of the beverage itself is used as a coolant.

U.S. Pat. No. 4,368,766, discloses a self-cooling water container that is capable of keeping the temperature of the contained water lower than the ambient temperature by utilising the heat of water vaporisation. The container has a container wall that is made from a water-repellent, continuously porous resin material or from a gas permeable laminate including such as material as a major ply element. Since such material is water-repellent, water in the container does not soak into the material and ooze through to the outside, as in containers made of unglazed pottery, leather or cloth. Instead, water in the container vaporises on the inner surface of the wall, and passes through continuous fine pores in the wall as water vapour to the outside. Heat utilised in the process of water vaporisation on the inner surface of the wall absorbs heat from the water in the container. Thus, the water temperature inside the container is kept lower than the ambient temperature.

Another such self-cooling beverage container with a permeable wall is disclosed by US-A-2006/0019047, which utilises a moisture vapour permeable, non-porous membrane to provide evaporative cooling. The permeable membrane is monolithic and pinhole-free, and provides evaporative cooling by allowing moisture vapour to escape while preventing penetration of contaminants, including liquids, particulates and bacteria. The membrane may be laminated to a fabric material for reinforcement.

US-A-2002/0112499 discloses an evaporative cooling article including a non-woven fabric that is water absorbent and exposed to the atmosphere, the evaporative cooling article being effective for exerting an evaporative cooling effect on a liquid held within a container, when the container is in contact with the evaporative cooling article. In some embodiments, the cooling article may comprise a pouch for at least partially enclosing such a container.

U.S. Pat. No. 5,983,662 discloses a hand-held beverage cooler-container which consists of a container structure and evaporative sponge material. The sponge material when wetted and placed in ambient air, draws heat away from the beverage by an evaporative process. The container structure may define a cavity adapted to accommodate a standard beverage can, such that said sponge material contacts the can.

U.S. Pat. No. 7,107,783 and discloses self-cooling containers for beverages and other liquids comprising porous matrices (or "porous vent materials") as elements of the container bodies to effect cooling of the contained liquids by pervaporation. Pervaporation comprehends the partial vaporisation of a liquid through a non-porous membrane. The liquid vapour can thus pass through the porous matrix directly to the environment or to a collector or trap comprising an absorbent material in contact with the container. The pervaporative matrix preferably forms part of the container body or housing and comprises between 5-100% of the total surface area of the container. The liquid contents of the container are cooled directly at the surrounding liquid/membrane interface owing to the latent heat of evaporation of the water. The resulting liquid vapour is lost through the matrix to the surrounding environment or to the collector or trap. The matrix may comprise a porous hydrophobic material, wherein the matrix allows the passage of small quantities of molecules of a volatile liquid vapour through the matrix, the evaporation of which cools the container, including any contents of the container. A suitable macroporous thermoplastic synthetic resin material may be made by sintering.

It has been found that the rate of cooling provided by coolers of the kind disclosed by U.S. Pat. No. 4,368,766 and U.S. Pat. No. 5,983,662 is insufficient. There is therefore a need for an improved evaporative cooling device having greater cooling power than prior art devices. Preferably, the cooling device should be capable of providing at least up to about 100 W cooling power.

Another problem associated with the prior art devices which rely on porous membranes or matrices is that they are unsuitable for use in in-line systems such as hydration systems of the kind mentioned above, in which water or other liquids are drawn off from the reservoir or bladder by means of the drinking tube on which the user sucks. When a partial vacuum is created by sucking on the drinking tube, the membrane or matrix leaks air inwards instead of allowing water to be drawn through the system. Accordingly, there is also a need for an evaporative cooling device that may be used with in-line systems such as hydration systems comprising a flexible reservoir or bladder and a drinking tube on which the user sucks to draw water from the reservoir or bladder.

An evaporative cooling system must also meet the above-mentioned requirement for portability.

In one aspect of the present invention therefore there is provided an evaporative cooling device for cooling water or other liquids, said device comprising a vessel adapted to receive water or another liquid, said vessel comprising a vessel wall, an outer layer of absorbent material that extends at least partially over said vessel wall, and a wick extending through said vessel wall, such that said wick is positioned to contact said water or other liquid within the vessel and is adapted to transport a portion of said water or other liquid through the wall by capillary action to said absorbent material, said wick being substantially impermeable to gas or vapour; the arrangement being such that water or other liquid transported from within the vessel to the outer layer by said wick is absorbed by the absorbent material, from which it evaporates, the heat required for such evaporation being removed from the water or other liquid disposed within the vessel through the vessel wall, thereby cooling such water or other liquid.

The evaporative cooling device of the present invention therefore incorporates a wick for conveying a portion of the water or other liquid within the vessel through the vessel wall to the absorbent material by capillary action. Wicks are well-known in the art and generally comprise a cord or strand of woven, twisted or braided fibres. Suitably, the wick of the present invention may be made from polypropylene or viscose materials, but other suitable materials will be apparent to those skilled in the art. The wick of the invention should be sufficiently tightly woven, twisted or braided and packed in position to render it substantially impermeable to gas and vapour in use, whilst allowing sufficient quantities of water or other liquid to be transported from the vessel interior to the absorbent material to provide adequate cooling power by evaporation.

Unlike the prior art devices of U.S. Pat. No. 4,368,766, U.S. Pat. No. 7,107,783 and US-A-2006/0019047, the wick of the present invention does not provide for the transport of water vapour across the vessel wall; and the cooling effect provided by the device of the invention arises from evaporation of the water or other liquid from the absorbent material of the outer layer, and not by vaporisation at the interface between the vessel wall and the contained water or other liquid. The wick of the present invention is adapted to convey water or other liquid from within the vessel by capillary action, which comprehends the ability of the wick to draw the water or other liquid into it, with the interstices between the fibres of the wick acting as small capillaries, allowing the wick to soak up said water or other liquid. Whilst some felt or sintered thermoplastic synthetic resin material wicks are known in the art, these are generally unsuitable for use in the present invention, because they are not impermeable to air and vapour. The wick of the present invention is therefore made of fabric and is non-sintered.

The rate at which the wick should be capable of transporting water or other liquid from within the vessel to the absorbent material may be calculated from the desired cooling power of the device of the invention having regard to the conditions in which the device will be used. The evaporation of 1 g of water absorbs 2260 J of energy. Accordingly, if it is desired to provide a device with a cooling power in the range 40-100 W, then at steady state, the device should be capable of conveying about 64-160 mg of water per hour. In some embodiments, the device of the present invention may incorporate a plurality of wicks; for example 2-20. Suitably, more than 10 wicks may be provided; preferably 15 or more. The rate at which the wick(s) are desired to convey water or other liquid from within the vessel to the absorbent material should be divided by the total number of wicks.

The vessel wall should suitably be constructed from a material or materials that are impermeable to gas and liquid and are capable of conducting sensible heat from the water or other liquid contained within the vessel to the water or other liquid absorbed by said outer layer. In some embodiments, therefore, said vessel wall may be constructed, at least in part, from metal such as aluminium foil. In practice, however, it has been found that provided the vessel wall is sufficiently thin, the rate at which such sensible heat may be conducted therethrough is largely independent of the material(s) from which the wall is made. In some embodiments therefore, the vessel may be constructed from a thermoplastic synthetic resin material such, for example, as polypropylene.

Said wick may extend through an aperture formed in the vessel wall. The wick should have a sufficient length to form a satisfactory air/vapour-tight seal with the wall. Accordingly, in some embodiments, said vessel wall may comprise a sleeve portion defining a channel that extends from within the vessel to the outside of said vessel wall, said wick being packed into said channel, the lengths of the sleeve portion and wick being such that said wick is substantially impermeable to gas or vapour. The wick may suitably protrude from said channel within the vessel and externally of the vessel.

Suitably, said wick may have a cross-sectional area in the range of about 10-15 $mm^2$ e.g., about 12.5 $mm^2$, and a length in the range of about 10-30 mm, preferably 15-25 mm, e.g., about 20 mm.

Suitably, said wick should contact said outer layer of absorbent material, and should preferably form an intimate contact therewith, so as to allow for the efficient transfer of water or other liquid from the wick to the absorbent material.

Said outer layer of absorbent material may extend over part or all of said vessel wall. Suitably, said outer layer should extend over substantially all, or at least a majority of an exterior surface of the vessel wall. Preferably, said outer layer is disposed in good thermal contact with vessel wall to facilitate the transfer of sensible heat from the water or other liquid disposed within the vessel through the wall to the water or other liquid absorbed by the outer layer. Preferably, said outer layer is sufficiently thin that the absorbed water or other liquid evaporates from a position in contact with or closely adjacent the vessel wall. The sensible heat is transmitted substantially uniformly through the vessel wall, where such wall is covered by said outer layer.

The outer layer may be made from any suitable absorbent material, such as a woven or non-woven fabric. Said absorbent material may have a raised nap or flock type surface to promote good evaporation of said water or other liquid therefrom. In some embodiments, said absorbent material may comprise any suitable natural or manmade polymer. Some non-exhaustive examples of suitable natural polymeric fibres are cotton, flax, wool, bagasse, jute and silk. Some non-exhaustive examples of suitable synthetic polymeric fibres are cellulose-based materials, such as rayon, cellulose nitrate, cellulose acetate, cellulose triacetate; polyamides, such as nylon-6, nylon-6,6; polyesters, such as polyethylene terephthalate; polyolefins, such as isotactic polypropylene or polyethylene; or any of these in combination. Preferably, the absorbent material comprises nonwoven polymer microfibres or nonwoven viscose rayon fibres, polypropylene fibres or a blend of viscose and polypropylene fibres. Further suitable absorbent materials are disclosed by US-A-2002/0112499, the contents of which are incorporated herein by reference. In view of the requirement that the outer layer should be thin, it is desired to use fabrics with minimal loft.

In some embodiments, the outer layer may be adhered to the outer surface of the vessel. Alternatively, said outer layer may be configured to form a close or tight fit around the vessel. For instance, the outer layer may form a close-fitting "sock" that is shaped to form a tight fit over the vessel. The outer layer may be elasticised.

In yet further embodiments, said outer layer may comprehend a coating that is applied directly to the outer surface of the vessel. Said coating may comprise an absorbent hydrogel.

In some embodiments, said outer layer may be covered by a non-absorbing outer cover with a reticulated structure, so that it does not interfere with the evaporation of water from the outer layer, but keeps the vessel substantially dry to the touch. Said outer cover may overlay substantially all of the vessel, and may comprise a non-porous material having an open or reticulated structure.

An advantage of the evaporative cooling device of the present invention is that it may be used in-line with an hydration system of the kind comprising a flexible reservoir or bladder and a drinking tube, which is preferably flexible, so that it can be mounted for convenient access by the user when required. Examples of such hydration systems are disclosed by WO-A-98/08770 and WO-A-02/08077. The vessel of the evaporative cooling device according to the present invention may comprise an outlet for withdrawing cooled water or other liquid from the vessel and an inlet that may be connected to a reservoir that is adapted to contain water or other liquid. Thus, in some embodiments, said inlet may be connected to the reservoir of such an hydration system, and said evaporative cooling device may be connected in-line with the drinking tube.

Typically, said inlet may be connected to the reservoir by means of a connecting tube, which is preferably flexible, and the outlet of the evaporative cooling device may be connected to said drinking tube which may be fitted with a mouthpiece distally of the cooling device. Suitably, said mouthpiece may be selectively operable to allow water or other liquid to be discharged from the drinking tube therethrough and, when not in use, to provide a substantially airtight seal at or near the end of the drinking tube. Conveniently, said mouthpiece may be bite-operated. Suitable such mouthpieces are known to those skilled in the art, for example those disclosed in the WO-A-00/03945 and WO-A-00/03946.

Said reservoir may comprise a flexible reservoir wall and may have a capacity in the range 1-5 L, preferably 2-4 L, e.g., about 3 L. Said reservoir may be adapted to be carried on a convenient location on the user's body, for example the user's back or waist. To this end, the reservoir may be equipped with suitable straps, clips or other attachment means for conveniently mounting/dismounting the reservoir from the user's body. Said reservoir may have a reservoir outlet port that is positioned such that in use, as water or other liquid is drawn from the reservoir, the water or other liquid within the reservoir drains under gravity towards said outlet port. Thus, the reservoir generally defines an upright orientation, and the outlet port is positioned at or towards the bottom of the reservoir. As the water or other liquid is drained from the reservoir, the flexible reservoir wall collapses to take up the space vacated by the water or other liquid, thus maintaining the interior pressure of the reservoir and avoiding the need for an air-inlet valve. The flexible reservoir also allows the system to be charged with water or other liquid before use, by manually squeezing inwardly the flexible reservoir wall, thus driving water or other liquid out of the reservoir through the outlet port into the evaporative cooling device.

Preferably, the arrangement is such that upon withdrawing water or other liquid from the vessel through said outlet, the vessel is automatically replenished with water or other liquid from said reservoir. In some embodiments, the vessel of the evaporative cooling device may be adapted to be completely filled with water or other liquid in use, and except when the mouthpiece is operated to draw water from the drinking tube, the system may be substantially airtight. Unlike the reservoir, the vessel of the evaporative cooling device is suitably substantially inflexible, so that its interior volume remains substantially constant irrespective of the internal or external pressure. The evaporative cooling device may be positioned above or below the level of the outlet port of the reservoir in use, and once the system has been fully charged with water or other liquid, when a user sucks cooled water from the drinking tube via the mouthpiece, the water or other liquid in the evaporative cooling device is replenished with water or other liquid drawn into the vessel from the reservoir by such suction. The selectively-operable mouthpiece prevents the admission of air into the system when water or other liquid is not being drawn from the drinking tube, thereby preventing the water or other liquid in the vessel from draining back into the reservoir.

Advantageously, the vessel of the evaporative cooling device has a capacity in the range of about 100 mL about 1500 mL.

Preferably, said vessel is configured such that as said water or other liquid is withdrawn from the outlet, the water or other liquid is constrained to flow within the vessel progressively from the inlet to the outlet. This prevents water or other liquid from mixing freely within the vessel and, in particular, prevents water or other liquid that is freshly introduced to the vessel from mixing with water or other liquid that is closer to the outlet and will therefore usually have been in the vessel for a longer period of time and cooled by operation of the evaporative cooling device.

If the evaporative cooling device of the present invention is allowed to stand filled with water or other liquid for a sufficiently long period of time, then assuming the cooling power of the device is substantially uniform, all of the water or other liquid within the vessel will be cooled to the same temperature at or close to the wet bulb temperature of the device. However, in normal use, a user will periodically withdraw amounts or doses of water or other liquid from the cooling device which will be replenished from the reservoir in the manner described above; and as cooled water or other liquid is withdrawn from the device, fresh water or other liquid at a higher temperature will be introduced into the device. If the user withdraws water or other liquid from the cooling device at intervals shorter than the time required to lower the temperature of all the water or other liquid in the vessel to the wet bulb temperature, then such continual movement of the water through the device from the inlet to the outlet will establish a temperature gradient from the inlet to the outlet. Preferably the system is configured and dimensioned such that at least a volume of water corresponds to a typical dose amount (e.g., 75-150 ml) at or near the wet bulb temperature is provided adjacent the outlet at intervals of 5-15 minutes, preferably every 10-12 minutes.

In some embodiments, said vessel may comprise at least one elongate tube that is sufficiently narrow to prevent mixing of water or other liquid along its length. Preferably, such at least one elongate tube should be flexible to allow it to be folded in order to be carried conveniently. The or each elongate tube may have an internal diameter in the range about 5-10 mm, preferably about 7-8 mm, and may have a length of at least 2 m, preferably at least 3 m and typically at least 5 m. The or each elongate tube may be provided with a plurality of wicks, which may be regularly spaced along the length of the tube(s).

Alternatively, said vessel may comprise a plurality of chambers that are arranged between said inlet and said outlet, the water or other liquid passing successively through said chambers as the water or other liquid is withdrawn from the outlet. The segmented nature of the device thus helps prevent water or other liquid at ambient temperature mixing with water that has been in the device for longer and is therefore substantially cooler. Each chamber may have a chamber wall that is covered at least partially by an outer layer of said absorbent material and a wick extending through said chamber wall for transporting a portion of the water or other liquid within the chamber by capillary action to said outer layer. In some embodiments, said vessel may comprise at least five such chambers, preferably at least 10 chambers, and typically 15-20 chambers. Each chamber may have an internal volume of about 25-50 mL, preferably 35-45 mL.

Each chamber may comprise a chamber inlet port and a chamber outlet port for connecting the chamber to the chamber inlet port of the next succeeding chamber, and a plurality of baffles that are arranged within the chamber to constrain the water or other liquid to flow progressively between said chamber inlet and outlet ports along a tortuous path. Said chambers may be interconnected by short lengths of tube extending between said inlet and outlet ports. Said chambers may be mounted on a common supporting structure such for example as a strip or band of webbing.

Further, each chamber may have a generally plate-like configuration, said chambers being arranged as a stack, with adjacent chambers being spaced apart to allow air to flow therebetween. Each chamber may comprise an internal skeletal structure for rigidity and a thin chamber wall to facilitate the transfer of sensible heat from the water or other liquid within the chamber to the water or other liquid absorbed by the outer layer. Said thin chamber wall may comprise one or more panels of metal (e.g., aluminium) foil supported by said skeletal structure. Said outer layer is preferably shaped and dimensioned to overlay wholly or substantially wholly said one or more panels.

By means of such a construction and arrangement, the evaporative cooling device at present invention may have the ability to deliver periodic drinks over a 10-40 minute period, with consumption being in the order of 200 mL to 1500 mL per hour, depending on conditions experienced by the user.

In some embodiments, said evaporative cooling device of the invention may further comprise a motorised fan for increasing the airflow over said outer layer, thereby increasing the rate at which said water or other liquid is evaporated from said absorbent material.

Said motorised fan may be mounted on or juxtaposed said vessel, for example on said reservoir, when the evaporative cooling device is incorporated in an hydration system as described above. In some embodiments, said vessel may be mounted within a hollow air-duct, and said motorised fan may be mounted at one end of the air-duct, thereby to cause said airflow to be ducted over said outer layer. A filter may be provided to prevent dust and/or dirt contaminating the absorbent material of the outer layer.

Advantageously, said motorised fan may be solar powered, and a solar panel may be fitted to said reservoir, where the evaporative cooling device is incorporated in an hydration system. Alternatively, the motorised fan may be powered by a battery.

According to another aspect of the present invention, there is provided a cooling garment incorporating a supply of cooled drinking water or other liquid, said garment comprising a garment portion that is adapted to be worn by a user, said garment portion incorporating integrant channels for conveying cooled water or other liquid through at least part of said garment portion for cooling the user, said integrant channels having an inlet port and an outlet port; a reservoir that is adapted to contain a supply of water or other liquid; an evaporative cooling device in accordance with the invention that is arranged to receive water from said reservoir and from the outlet port of said garment portion and to deliver cooled water or other liquid to the inlet port of said garment portion and to a separate outlet for providing cooled water or other liquid drinking.

In some embodiments, said water or other liquid may be caused or allowed to circulate through said integrant channels and said evaporative cooling device by thermal siphoning or by means of a pump. Said pump may be solar powered. Said vessel may act as a "header tank" for the cooling garment.

Suitably, said garment portion may comprise a jacket, vest or other garment adapted to be worn over the user's upper body.

Following is a description by way of example only with reference to the accompanying drawings of embodiments of the present invention.

In the drawings:

FIG. 3 is a sectional end view of one of the individual cooling elements of FIG. 2;

FIG. 4 is a plan view of the individual cooling element of FIG. 3;

FIG. 5 is a sectional side view on the line V-V of FIG. 3, showing the detail of the wick assembly;

FIG. 6 is a sectional plan view on the line VI-VI of FIG. 3;

Figure 1:
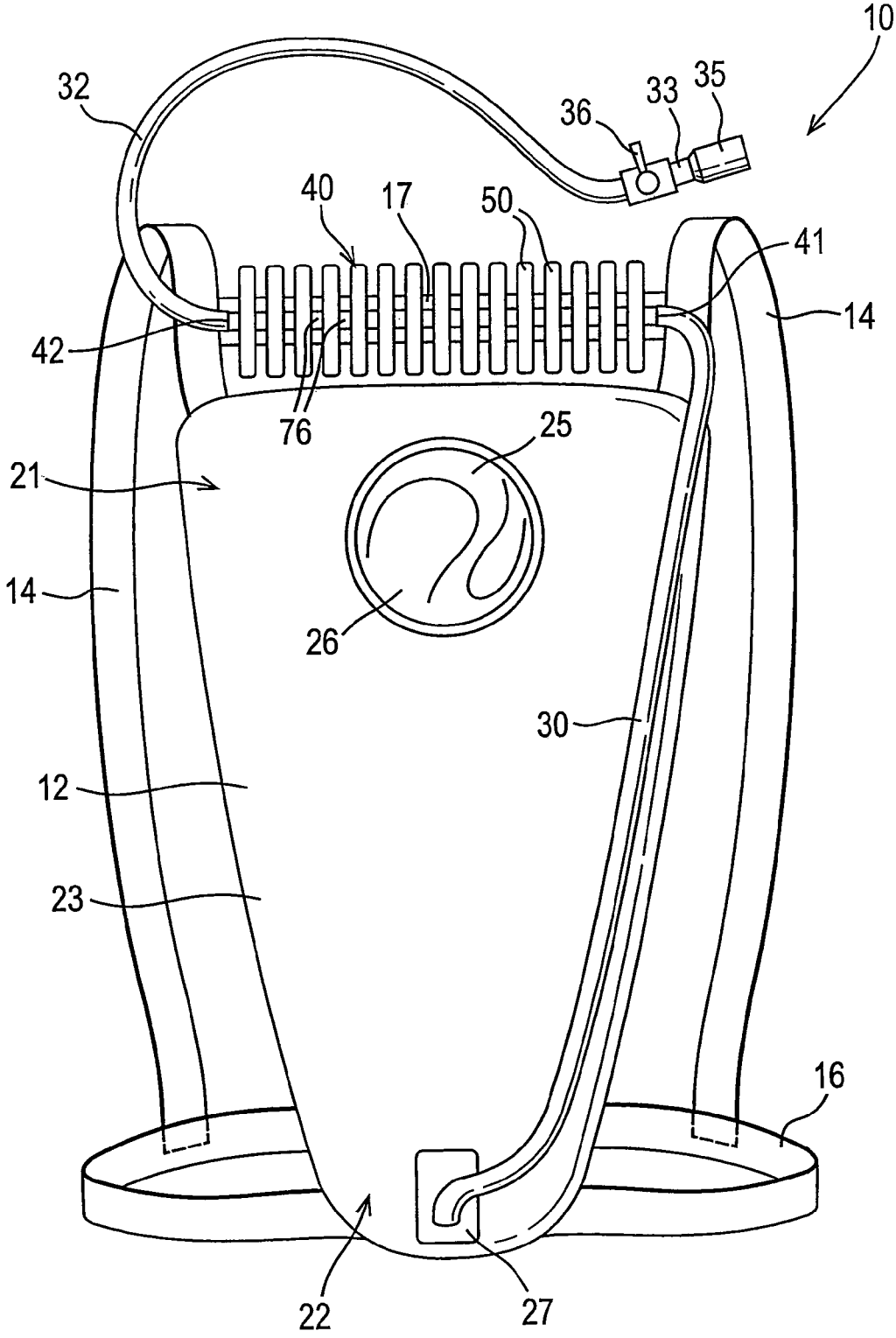
FIG. 1 shows a portable, personal hydration system incorporating an evaporative cooling device in accordance with the present invention.

With reference to FIG. 1 of the accompanying drawings, a portable, personal hydration system 10 comprises a flexible reservoir or bladder 12 having a capacity of 2-5 L, for example about 3 L, that is incorporated into a backpack having shoulder straps 14 and a belt 16 to which the shoulder straps 14 are connected at their lower ends.

The flexible reservoir 12 thus defines an upright orientation, with an upper end 21 and a lower end 22. The flexible reservoir 12 is thus adapted to be worn on a user's back in the conventional manner.

The reservoir 12 is watertight, having a flexible wall 23, and has an inlet port 25 juxtaposed said upper end 21 and an outlet port 27 at or towards said lower and 22. Said inlet port 25 is equipped with a manually removable closure 26, of the kind generally well-known in the art. Water or other liquids may be admitted into the reservoir 12 via the inlet port 25, and the reservoir 12 is configured such that when upright, said water or other liquids drain under gravity towards the lower end 22 of the reservoir 12 and said an outlet port 27, which outlet port 27 is connected to a flexible connecting tube 30.

In FIG. 1, said connecting tube 30 is shown externally of the reservoir 12 for clarity, but it may be covered by a suitable sleeve or flap (not shown), or mounted within the body of the reservoir 12 as desired, for protection, having regard to the fact that the hydration system 10 should desirably have a generally rugged construction for outdoor use.

Said connecting tube 30 extends from said outlet port 27 to the inlet 41 of an evaporative cooling device 40 in accordance with the present invention, which is described in greater detail below. Said evaporative cooling device 40 has an outlet 42 and is mounted on a webbing band 17 that extends between the said shoulder straps 14, such that the evaporative cooling device 40 is disposed at the upper end 21 of the reservoir 12. Optionally, said webbing band 17 may be positioned sufficiently close to the upper end 21 of the reservoir 12 that the evaporative cooling device 40 is supported, at least partially, by the reservoir 12.

The outlet 42 of the evaporative cooling device 40 is connected to a flexible drinking tube 32 of the kind known to those skilled in the art, which drinking tube 32 is fitted at its distal end 33 with a mouthpiece 35 and a selectively operable valve 36 for opening/closing the drinking tube 32, such that the evaporative cooling device 50 is effectively connected in-line between the drinking tube 32 and the reservoir 12. Said valve 36 may be manually operable or, in other embodiments, it may be replaced by a bite-operated valve (not shown) that is incorporated in a mouthpiece 35. By way of example, suitable bite-actuated mouthpieces are disclosed by WO-A-00/03945 and WO-A-00/03946. When closed, the valve 36 forms an airtight seal, such that the reservoir 12, connecting tube 30, evaporative cooling device 40 and drinking tube 32 form a closed, airtight system.

Figure 2:
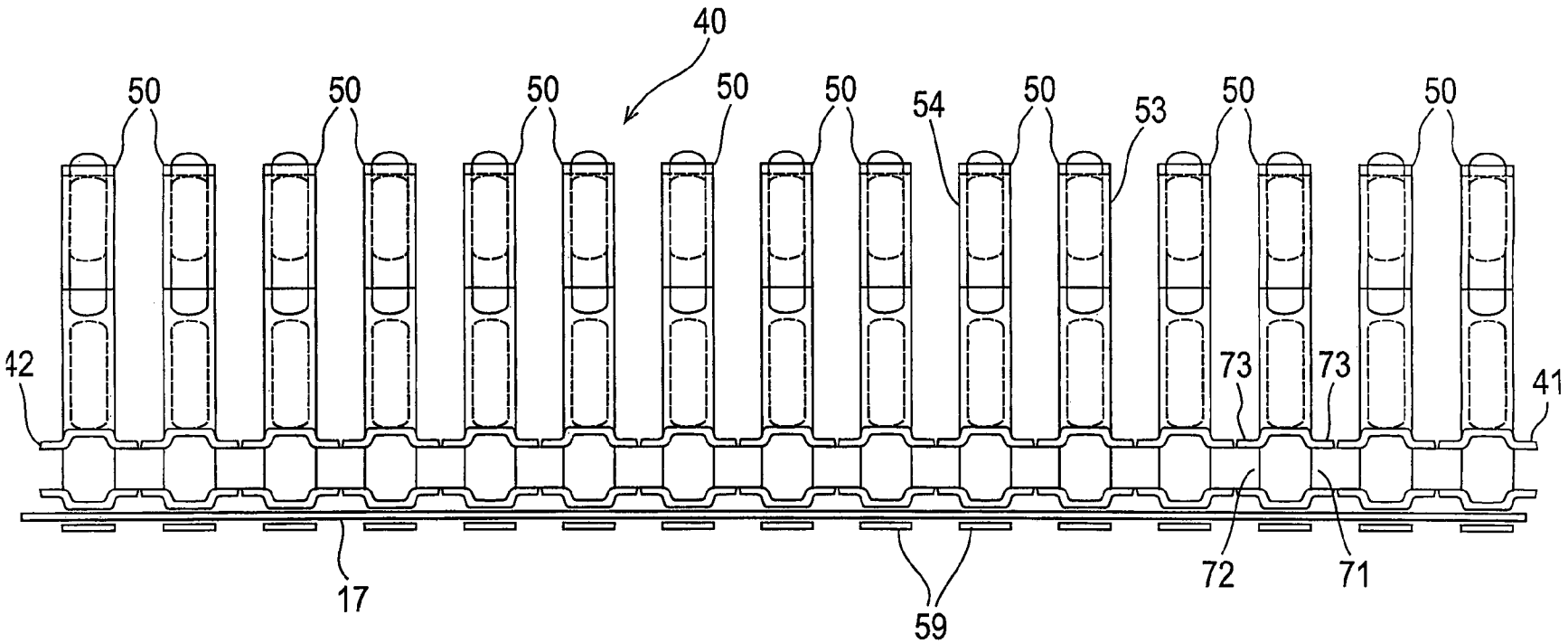
FIG. 2 is a side elevation of an evaporative cooling device according to the invention, with the absorbent outer layer omitted for clarity, the evaporative cooling device comprising a regular series of individual cooling elements.

As shown in FIG. 2, the evaporative cooling device 40 is formed from a plurality of individual, generally plate-like cooling elements 50 that are interconnected and mounted in the form of a stack on said webbing band 17 in the manner described below. In the example illustrated, the cooling device 40 comprises 15 cooling elements 50, although generally a device according to the invention may comprise about five to about 20 such elements, and alternatively, if desired, the elements may be integrally manufactured as a single piece.

Each individual cooling element 50 comprises a skeletal structure 52, which may conveniently be manufactured from a thermoplastic synthetic resin material such, for example, as polypropylene. The skeletal structure 52 may be manufactured as two similar halves 51A and 51B, as indicated in FIG. 4, which halves 51A, 51B may then be adhered to one another as shown in any suitable manner known to those skilled in the art, such as gluing or plastic welding.

Said skeletal structure 52 defines a generally plate-like configuration having a narrow, solid peripheral wall 55 that is formed in a generally rectangular configuration with two spaced, parallel longitudinal portions 56, 57 that are interconnected by two end portions 58. In the embodiment shown in the drawings, said longitudinal portions 56, 57 have a length each of about 96 mm, and the end portions 58 have a length each of about 40 mm. The peripheral wall 55 has a width of about 6.5 mm. Said skeletal structure 52 also includes a second internal wall 60 that extends parallel to said longitudinal portions 56, 57 and terminates at each end short of the interconnecting end portions 58, and a plurality of ribs 62 extending between one of the longitudinal portions 56 and said second internal wall 60 to define a rectangular cavity 63 between each pair of adjacent ribs 62. In the embodiment shown, the peripheral wall 55, internal walls 60 and ribs 62 all have a thickness of about 1 mm. Said second internal wall 60 and said ribs 62 are of substantially the same width as the peripheral wall 55, and each rib 62 defines an aperture 64 therethrough which, in the embodiment shown, has an area of about 40 $mm^2$ to allow each cavity 63 to communicate with the adjacent cavities 63, the apertures 64 being formed alternately juxtaposed the one longitudinal portion 56 and the second internal wall 60, as best illustrated in FIG. 3, to define a sinuous path successively through the series of cavities 63.

Between said second internal wall 60 and the other longitudinal portion 57, the skeletal structure 52 includes a centrally disposed shaped portion 70 that defines an inlet port 71 and an outlet port 72 that are substantially axially aligned with one another, as best seen in FIG. 6. Each of said inlet and outlet ports 71, 72 has an internal diameter of about 7 mm. A diagonal wall portion 74 is interposed between said inlet and outlet ports 71, 72 to separate them from each other. As shown in the FIG. 3, the peripheral wall 55 defines with the internal wall 60 and the end-most ribs 62 a peripheral channel 67 that is divided by the shaped portion 70 into a generally L-shaped inlet leg 68 and a generally L-shaped outlet leg 69. The apertures 64 in the end-most ribs 62 provide for communication between the sinuous path through the series of cavities 63 and the respective inlet and outlet legs 68, 69 of the peripheral channel 67. As shown in FIG. 6, said shaped portion 70 and diagonal wall 74 are configured and arranged to allow respectively said inlet port 71 to communicate only with the inlet leg 68 of the peripheral channel 67 and the outlet port 72 to communicate with the outlet leg 69.

With reference to FIG. 2, the shaped portion 70 is shaped circumjacent each of the inlet and outlet ports 71, 72 to provide an annulus 73 that is configured to fit tightly in a substantially airtight manner in a respective end of a short length of interconnecting tube 76 (see FIG. 1) having an internal diameter about 7 mm for interconnecting the outlet port 72 of each individual cooling element 52 and the inlet port 71 of the next succeeding element 52.

The skeletal structure 52 of the cooling element 50 thus defines two opposite, generally rectangular major faces 53, 54, each having a surface area of about 3800-3900 $mm^2$. It will be recognized that the relative large size of the major faces 53, 54 as compared with the width of the peripheral wall 55 gives rise to the plate-like shape of the cooling element 50. Each of said faces 53, 54 carries a thin heat-transmitting wall that is bonded to the peripheral wall, 55, internal wall, 60 and ribs 62 in an airtight manner by any suitable means known to those skilled in the art in order to seal the element 50 and to separate each cavity 63 and L-shaped legs 68, 69 from the others. Suitably, said heat-transmitting wall maybe made from metal foil, such for example as aluminium foil. It will be appreciated that in addition to defining the internal structure of each cooling element 50, the skeletal structure 52 also provides support for said thin-heat transmitting walls, so that such walls do not deflect inwardly to any substantial extent when the interior pressure in the cooling element 50 is depressed relative to ambient pressure, thereby maintaining a substantially constant volume within the element 50.

It will be appreciated from the foregoing that each cooling element 50 has an internal volume of approximately 25 mL, although the precise dimensions of the elements 50 may be varied from those specified above provided that such internal volume of each element remains within the range of about 15-50 mL. The internal volume of the evaporative cooling device 40 as a whole therefore is in the range of about 150 mL to about 750 mL, depending upon the actual volume of each individual cooling element 50, the volume of the interconnecting tube portions 76 and the number of cooling elements 50. Preferably, the evaporative cooling device has a capacity in the range of about 250 mL to about 600 mL, e.g., about 350-400 mL.

Figure 8:
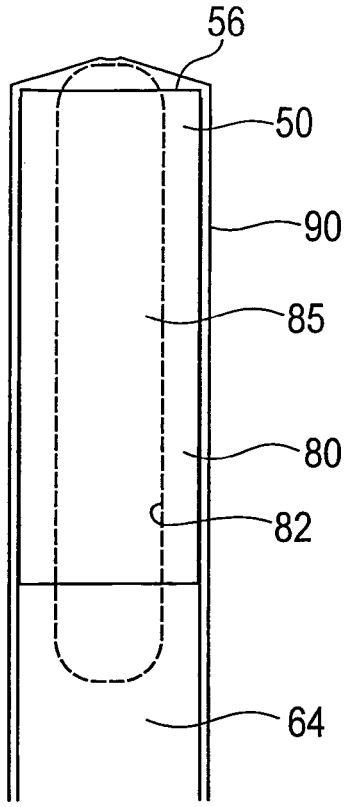
FIG. 8 is a sectional side view on the line VIII-VIII of FIG. 7, showing the detail of one of the cooling elements, with the outer layer in situ.

As illustrated in FIGS. 3 and 5, the skeletal structure 52 also comprises an interiorly disposed, elongated sleeve portion 80 that defines a cylindrical recess 82 that extends through the peripheral wall 55 and opens into the respective aperture 64 of one of said ribs 62. In the embodiment shown, said sleeve portion 80 has a length of about 16 mm and an internal diameter of about 3.7-4 mm. Said recess 82 accommodates a wick 85 that comprises a length of braided fibres, which wick 85 protrudes from each end of said sleeve portion 80, as best illustrated in FIGS. 5 and 8. Said wick 85 may be made from polypropylene or viscose fibres, or other suitable materials, and forms a snug fit in the recess 82. The wick 85 is adapted to convey water or other liquid from the interior of the cooling element 50 to the exterior by means of capillary action, which comprehends the ability of the wick 85 to draw such water or other liquid into it, with the interstices between the fibres of the wick 85 acting as small capillaries, allowing the wick 85 to soak up water or other liquid. The fibres of the wick 85 are sufficiently tightly braided, and the wick 85 is sufficiently tightly packed in the sleeve portion 80 such that in use, when saturated with water or other liquid, the wick is substantially impervious to air or other gas or vapour. The dimensions given above for the wick 85 and sleeve portion 80 may be adjusted by those skilled in the art, provided that the wick 85 is sufficiently long so that air is not drawn into the cooling element 50 from outside when the interior pressure of the cooling element 50 is lowered relative to ambient pressure, whilst the wick 85 is capable of conveying water or other liquid from within the cooling element 50 to the outside.

Said other longitudinal portion 57 of the peripheral wall 55 carries an elongated loop portion 59 that is shaped to receive said a webbing band 17, said band 17 being threaded as shown in FIG. 2 through the loop portions 59 of the stack of cooling elements 50, such that each element 50 is individually connected to the band 17. It will be recognized that the evaporative cooling device 40 as hereinbefore described need not be mounted to a webbing band 17 extending between said shoulder straps 14 of the reservoir 12, but may be mounted, by means of said loop portions 59 to any convenient strap or band forming part of or attached to the reservoir 12. For instance, in some embodiments, the evaporative cooling device 40 may be mounted to a single one of the shoulder straps 14 or to the belt 16, as convenient.

Figure 7:
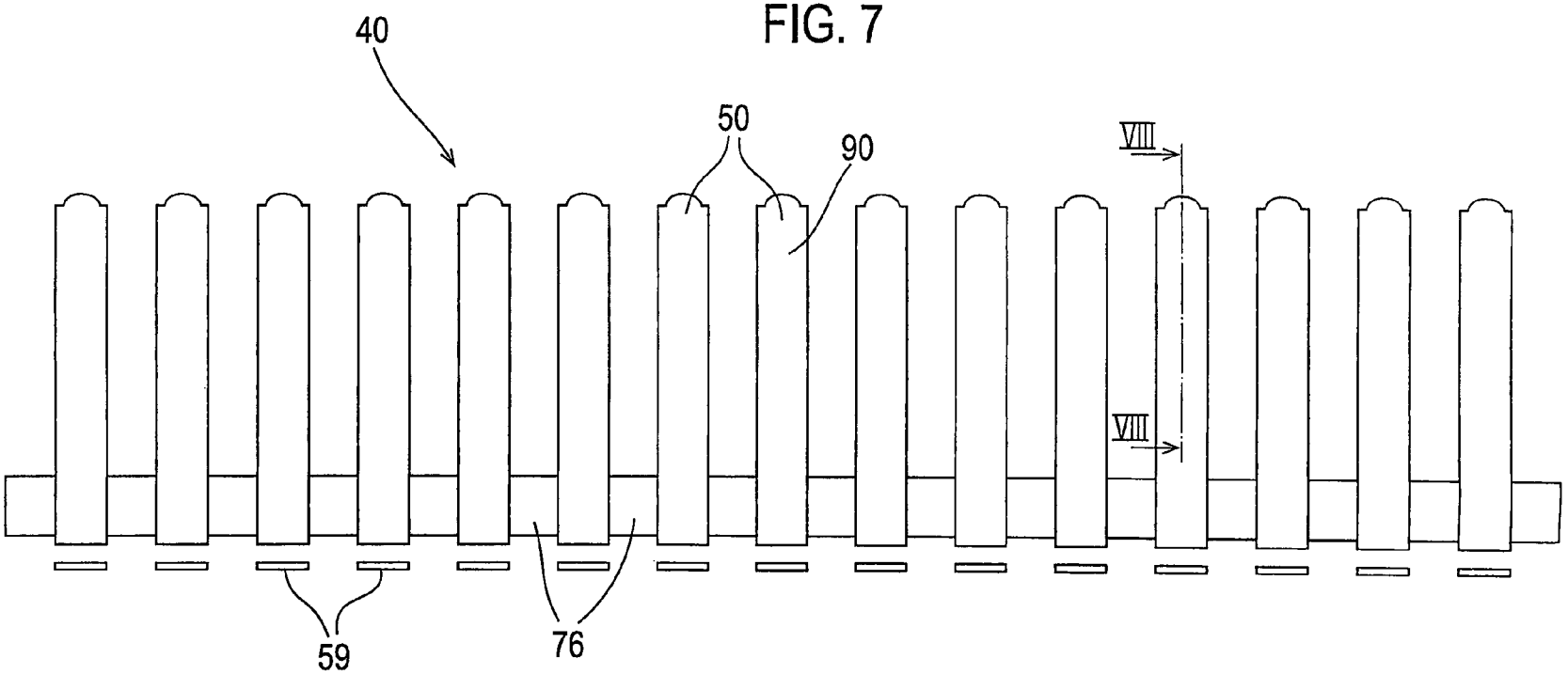
FIG. 7 is a side elevation of the evaporative cooling device according to the invention corresponding to FIG. 2, with the absorbent outer layer shown, and with the webbing band 17 and inter connecting tubes 76 omitted.
Figure 9:
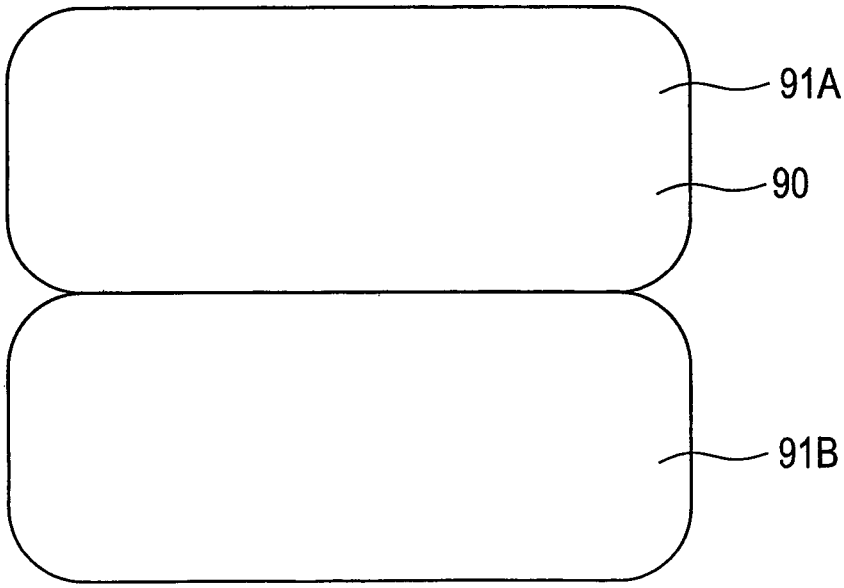
FIG. 9 shows the configuration of an outer layer of absorbent material for fitting to one of the cooling elements.

As illustrated in FIGS. 7 and 8, each of the cooling elements 50 of the evaporative cooling device 40 according to the invention carries an outer layer of absorbent fabric material 90. Said outer layer of absorbent fabric material 90 may be made from any suitable absorbent material known to those skilled in the art as mentioned above, but in the embodiment described comprises nonwoven viscose rayon fibres, polypropylene fibres or a blend of viscose and polypropylene fibres. More generally, said outer layer may be a non-woven material, a braided wick or a flock type of fibre applied to the surface of the cooling element 50. As illustrated in FIG. 9, said outer layer 90 is formed as a single piece of fabric having two conjoined wing portions 91A and 91B. Each of said wing portions 91A, 91B is shaped to overlay the heat transmitting wall on a respective one of said major faces 53, 54. In order to fit the outer layer 90 to the respective cooling element 50, each wing portion 91A, 91B is stretched over its respective face 53, 54 and then lightly glued thereto in order to form a close contact between the outer layer and the heat-transmitting walls; suitable glues are known to those skilled in the art. As shown in FIG. 8, juxtaposed the one longitudinal portion 56 of the skeletal structure 52, the outer layer 90 also overlays the wick 85 where it protrudes from said sleeve portion 80, such that an intimate connection is formed between the outer layer 90 and the wick 85 to enable water or other liquid to be efficiently transferred from the wick to the outer absorbent layer.

The fabric has a minimal loft, such that the outer layer 90 is quite thin, so that water or other liquid absorbed by the outer layer 90 evaporates therefrom closely adjacent or in contact with the walls of the cooling element 50, such that latent heat required to procure such evaporation is drawn largely from sensible heat from the water or other liquid within the cooling element 50.

In use, the reservoir 12 is charged with drinking water or another potable liquid via the inlet port 25, and the closure 26 is then fitted to the interport 25 in an airtight manner. With the valve 36 opened, the flexible wall 23 of the reservoir 12 is manually squeezed inwardly in order to force the water or other liquid therefrom via the outlet port 27 into the connecting tube 30, cooling device 40 and drinking tube 32, until such water or other liquid exits the drinking tube via the mouthpiece 35, indicating that the hydration system is fully charged with water or other liquid, with no air bubbles. The valve 36 is then closed to prevent the water or other liquid draining back from the evaporative cooling device 40 into the reservoir 12, when the pressure on the flexible wall 23 is released.

With the hydration system fully charged with water or other liquid, each cooling element 50 of the evaporative cooling device 40 is completely filled with water or other liquid which contacts the wick 85 in each cooling element 50. A portion of the water or other liquid in each cooling element 50 is therefore drawn into the wick 85 by capillary action and transported through the wick 85 out of the cooling element 50 into contact with the respective outer layer 90 that is fitted exteriorly of the cooling element 50. As the outer layer 90 is made of absorbent material, the water or other liquid removed from the interior of the cooling element 50 soaks through to substantially all of said outer layer.

The water or other liquid absorbed by said outer layer 90 continuously evaporates therefrom into the atmosphere, and the latent heat required for such evaporation is conducted as sensible heat through the walls of the cooling element 50, especially the thin heat-transmitting walls that are bonded to the major faces 53, 54 of the skeletal structure 52 of the element 50, thereby effecting cooling of the water or other liquid remaining within the cooling element 50. The rate of evaporation of the water or other liquid from the outer layer 90 depends upon numerous factors, including the temperature of the water or other liquid within the cooling device 40, ambient temperature and the relative humidity. The energy required to evaporate one gram of water is 2260 J, and thus to provide a cooling power of 40-100 W, 4.3-10.6 mg of water should be evaporated from each cooling device 50 per hour. If greater cooling power is required, then the number of cooling elements 50 may be increased.

Figure 10:
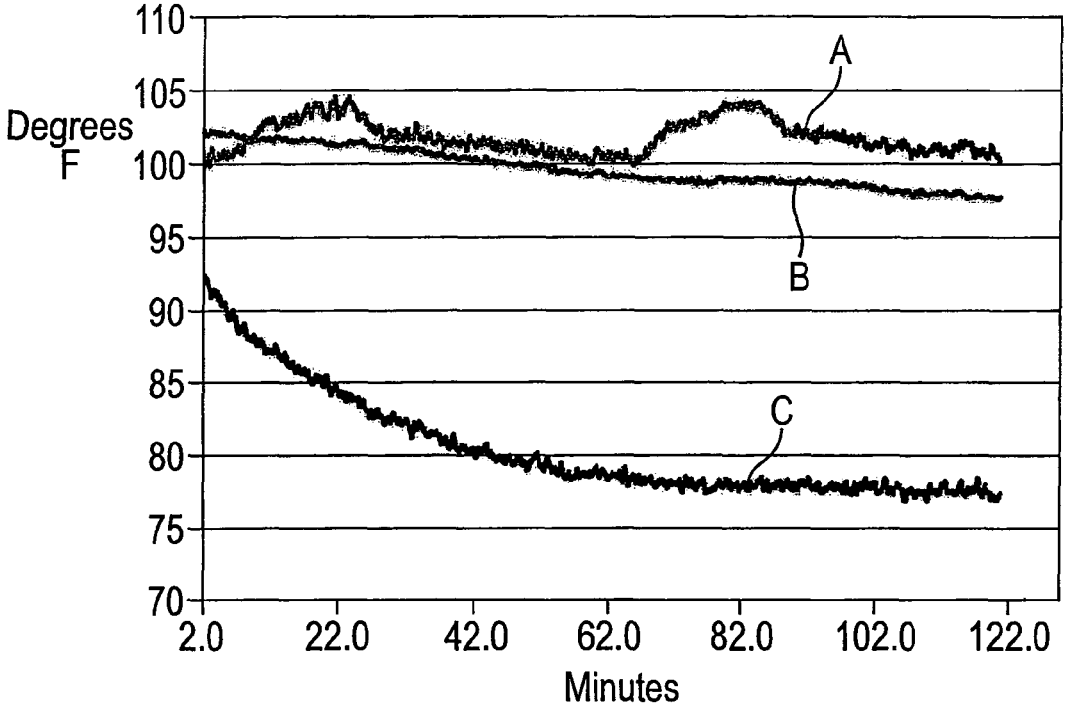
FIG. 10 is a graph of temperature verses time showing the performance of the evaporative cooling device of the invention in cooling water that is stationary in the device to below ambient temperature.

If cooling is allowed to continue, then the temperature of the water or other liquid within the cooling device 40 is progressively lowered to the wet bulb temperature which in dry, hot conditions may be as much as 25° C. below the dry bulb temperature. The evaporative cooling device 40 in accordance with the present invention has been found to be capable of cooling the volume of water or other liquid within the device 50 by at least about 15° C. within about 45 minutes, as shown in FIG. 10, in which line A is ambient temperature, line B is the temperature of the water or other liquid within the reservoir 12, and line C is the average temperature within the evaporative cooling device 40.

When a user desires to take a drink, he or she puts the mouthpiece 35 between his or her lips and opens the valve 36. Upon the user sucking on the drinking tube 32, the pressure in the system is reduced relative to the reservoir 12, and the water or other liquid is thereby caused to flow through the system out of the mouthpiece 35. As the water or other liquid flows through the system, it travels from the reservoir 12 via the connecting tube 30, from which it enters the evaporative cooling device 40 via the inlet 41, entering the first cooling element 50. Within each cooling element 50, the water or other liquid is constrained to follow the sinuous path from the inlet port 71, through the L-shaped inlet leg 68, through the series of adjacent cavities 63 to the L-shaped outlet leg 69, and thence to the outlet port 72 where it flows through the short interconnecting tube 76 to the next adjacent cooling element 50 and so on. It will be appreciated that such arrangement substantially prevents mixing of the water or other liquid within the evaporative cooling device 40. In particular, water at ambient temperature entering the evaporative cooling device via the inlet 41 is prevented from mixing with cooler water that is juxtaposed the outlet 42. Thus, as the water or other liquid is periodically drawn off the system by the user, the water entering the drinking tube 32 is taken from the evaporative cooling device 40 adjacent to the outlet 42, whilst water at ambient temperature enters the device 40 at the inlet 41, establishing a temperature gradient between said inlet 41 and said outlet 42.

Figure 11:
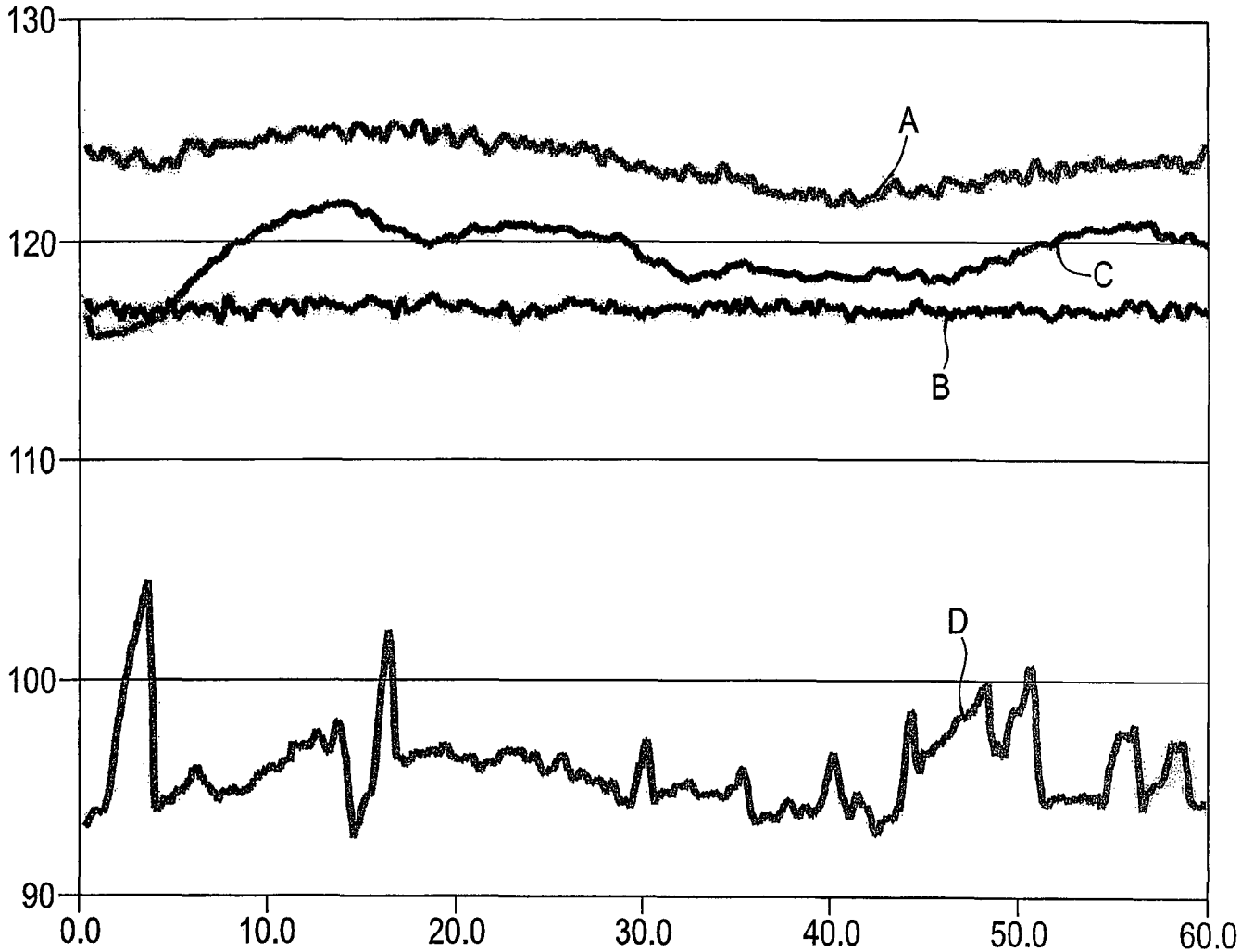
FIG. 11 is a graph of temperature verses time showing the performance of the evaporative cooling device in cooling water that is passed continuously through the device at a rate of about 15 mL/min.

If the user draws say 100 mL of water or other liquid from the system at approximately 10 minute intervals, then between each discharge, the evaporative cooling device 40 is capable of cooling the water or other liquid in the cooling device 40 sufficiently such that the next discharge of 100 mL drawn from the outlet end of the device 40 is also at the minimal temperature. An hydration system according to the present invention is capable of giving the user at least 6×100 mL per hour of drinking water cooled to a temperature of about 15° C. below ambient temperature. This may be simulated by measuring the temperature of the water or other liquid within the evaporative cooling device when the water or other liquid is caused or allowed to flow through the device 40 at a steady rate. FIG. 11 illustrates the result of a test in which water or other liquid was passed through the evaporative cooling device 40 of the present invention at a steady state of approximately 15 mL/min. In FIG. 11 line A, as before, represents ambient temperature, and line B represents the temperature of the water or other liquid within the reservoir 12. Line C represents the temperature of the water or other liquid at the inlet 41 to the evaporative cooling device 40, whilst line D represents the temperature of the water or other liquid at the outlet 42, having passed through the device 40. As will be seen, the evaporative cooling device 40 of the invention is capable of consistently maintaining the outlet temperature approximately 25° F. (about 14° C.) below the inlet temperature.

Figure 12:
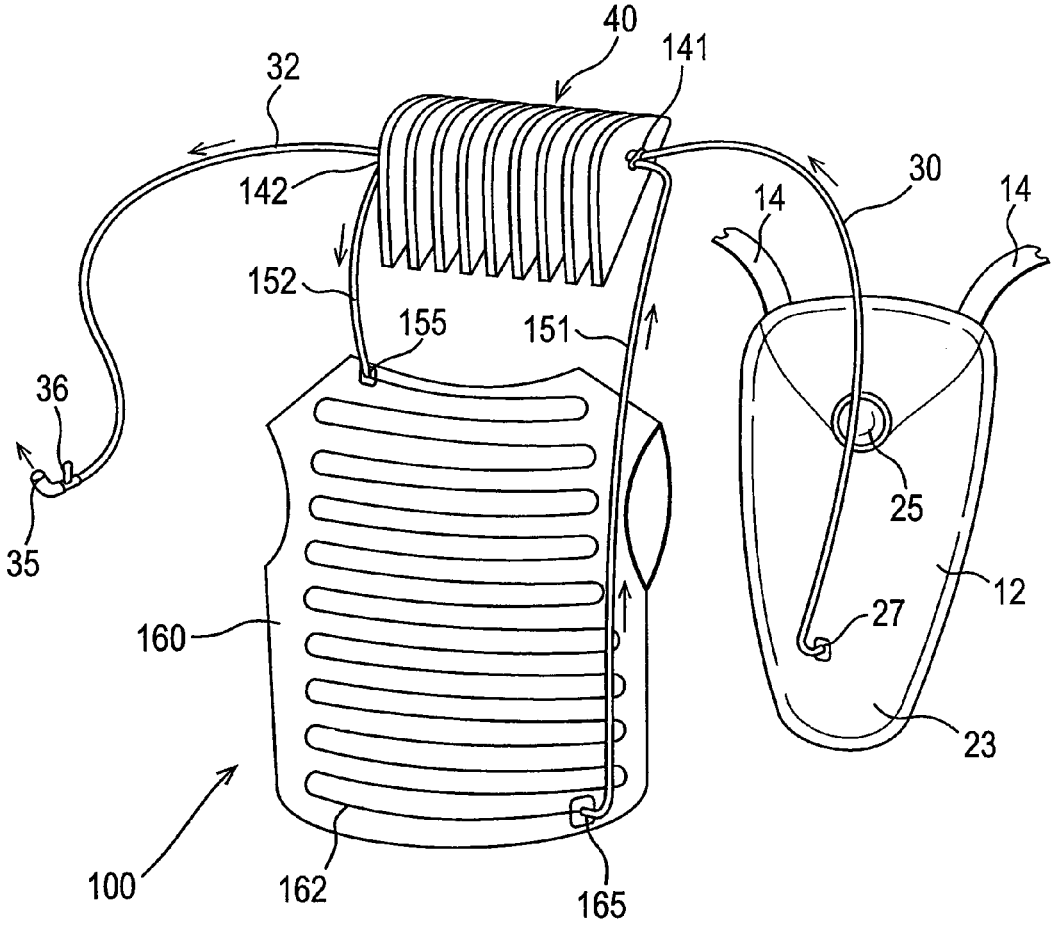
FIG. 12 shows schematically a cooling garment incorporating an evaporative cooling device in accordance with the present invention.

As illustrated in FIG. 12, the evaporative cooling device 40 according to the present invention may be incorporated in a cooling garment 100 which includes a supply of cool drinking water or other liquid. In FIG. 12, the same reference numerals are used as in FIGS. 1-11 for elements that are common to both embodiments of the invention.

Thus, the cooling garment 100 of the invention comprises an evaporative cooling device 40 that is connected in-line in an hydration system comprising a reservoir 12, a connecting tube 30, a drinking tube 32 and a mouthpiece 35. The features of such hydration system are substantially the same as those described for the hydration system illustrated in FIGS. 1-11 and need not further be described.

The evaporative cooling device 40 of the cooling garment of FIG. 12 differs from the cooling device 40 of the system of FIGS. 1-11 described above in that the inlet 141 is adapted for connection to a return tube 151 in addition to the aforementioned connecting tube 30. Similarly, the outlet 142 to the evaporative cooling device 40 is also adapted for connection to a supply tube 152 in addition to the drinking tube 32.

Said supply tube 152 is connected to the inlet port 155 of a garment portion 160. Said garment portion 160 comprises an article that is shaped in the form of an article of clothing, such, for example, as a vest. In the embodiment shown in FIG. 12, said vest is sleeveless, although this is optional, and the invention may be applied equally effectively to other articles of clothing as will be appreciated by those skilled in the art. For instance, in other embodiments, the garment portion may comprise a skullcap or the like adapted as an insert for a helmet.

Said inlet port 155 on the garment portion 160 is connected to one or more integrant channels or tubes 162 (in FIG. 12 one tube 162 is shown) that is or are distributed over substantially all of the garment in a sinuous manner as illustrated. Said one or more integrant channels or tubes 162 is or are connected in turn to an outlet port 165 on the garment portion 160 which is connected to said return tube 151. Suitably, said supply and return tubes 151, 152 are connected respectively to said inlet port 155 and outlet port 165 by means of quick-release fittings of the kind well known to those skilled in the art. The supply and return tubes 151, 152 and the one or more channels or tubes 162 distributed through the garment portion 160 form a substantially airtight system.

At the inlet 141 to the evaporative cooling device 40, the connecting tube 30 and return tube 152 merge or are connected to T-connector or the like. Similarly, at the outlet 142 to the evaporative cooling device 40, the drinking tube 32 and supply tube 152 merge or are connected to a T-connector or the like.

In use, with the mouthpiece 35 open, the system is charged, as before, by manually squeezing the flexible wall 23 of the reservoir 12 inwardly to force water or other liquid contained there in out through the outlets 27 into the connecting tube 30, from where it fills the evaporative cooling device 40, and also the supply and return tubes 151, 152 and the one or more integrant channels or tubes 162 distributed through the garment portion 160. When the system is entirely filled with water or other liquid, the valve 36 is closed. Cool drinking water may be drawn through the mouthpiece 35 at any time in the manner described above in relation to the embodiment illustrated in FIGS. 1-11 by sucking on the drinking tube 32.

Additionally, the water or other liquid contained within the system circulates continuously through the garment portion, acting to cool the wearer. Such water or other liquid may circulate naturally through the supply and return tubes is 151, 152 and the integrant channels or tubes 162 by means of thermal siphoning or, optionally, a pump 165 may be included in the system in order to cause the water or other liquid to flow around the system comprising the garment portion 160 and the evaporative cooling device 40.

Where such a pump 165 is provided, then it may be powered by means of a battery (not shown) or it may be solar powered, and for that purpose a suitable solar panel (also not shown) may be mounted conveniently on the reservoir 12.

Figure 13:
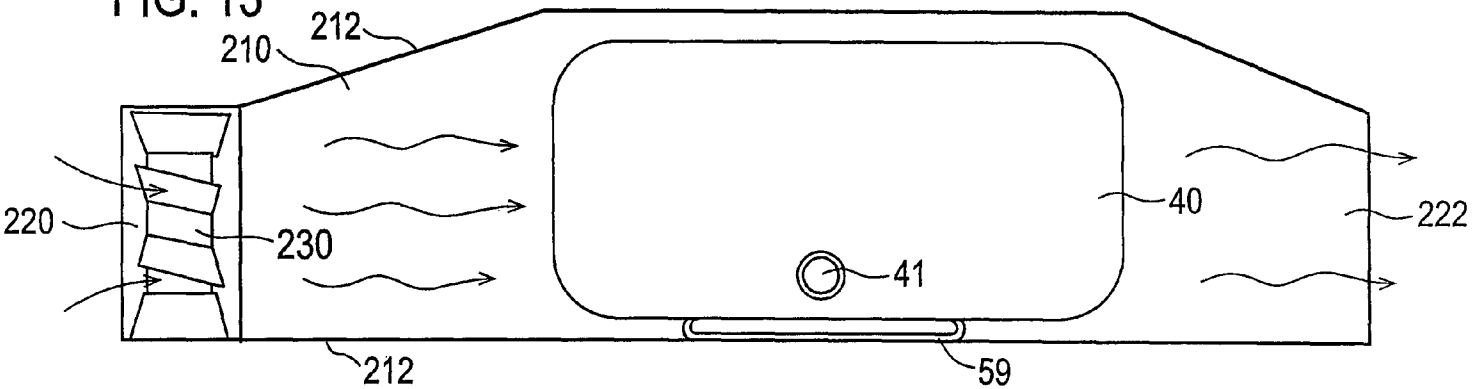
FIG. 13 is a sectional end elevation of an evaporative cooling device according to another embodiment of the invention in which the cooling device is fan-assisted.
Figure 14:
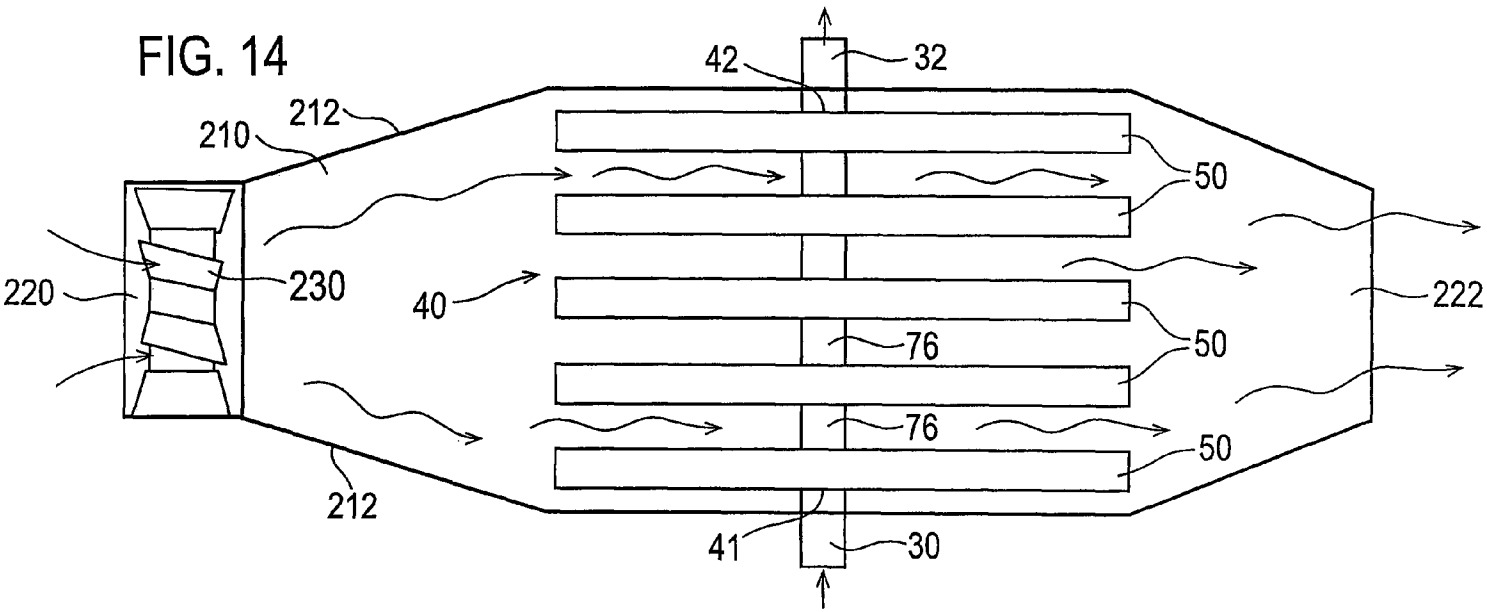
FIG. 14 is a sectional plan view of the fan-assisted cooling device of FIG. 13.

Another embodiment of an evaporative cooling device according to the invention is illustrated in FIGS. 13-14, in which the cooling device is fan-assisted in order to increase its cooling power. In FIGS. 13-14, the same reference numerals are used as in FIGS. 1-11 for elements that are common to both embodiments of the invention.

Thus, the evaporative cooling device 40 of FIGS. 13-14 has an inlet 41 that is connected to a connecting tube 30 for supplying water or other liquid from a suitable reservoir (not shown) and an outlet 42 for connection to a drinking tube 32. The evaporative cooling device 40 comprises a plurality of plate-like cooling elements 50; of which five are shown in FIG. 14.

Said cooling device 40 is accommodated within an air-duct 210 comprising one or more substantially solid peripheral walls 212 that surround the evaporative cooling device 40 and define an airflow path between an intake 220 at one end of the duct 210 and an exhaust 222 at an opposite end thereof. The one or more walls 212 of the duct 210 define a longitudinal axis through the duct that is parallel to the airflow path, and the evaporative cooling device 40 is oriented with respect to the said axis such that the cooling elements 50 are oriented substantially parallel to the axis as shown in FIG. 14.

Juxtaposed said intake 220, the duct 210 accommodates a motorised fan 230 that is arranged to impel air into the intake 220 and force it to flow over the cooling elements 50 of the evaporative cooling device 40. Said fan may be powered by a photovoltaic element (not shown) and a suitable solar panel may be mounted, for example, on the reservoir 12. The air conducted over the cooling elements 50 of the device 40 is exhausted through said exhaust 222. By such forced ducting of air over the cooling elements 50, the effective cooling power of each individual element 50 is increased. Thus, for a device having the same number of cooling elements 50, the total cooling power of the device 50 may be increased by the use of such an arrangement. Alternatively, if a more compact device is required, then the number of cooling elements 50 may be reduced, whilst maintaining the total cooling power of the device 40.

Figure 15:
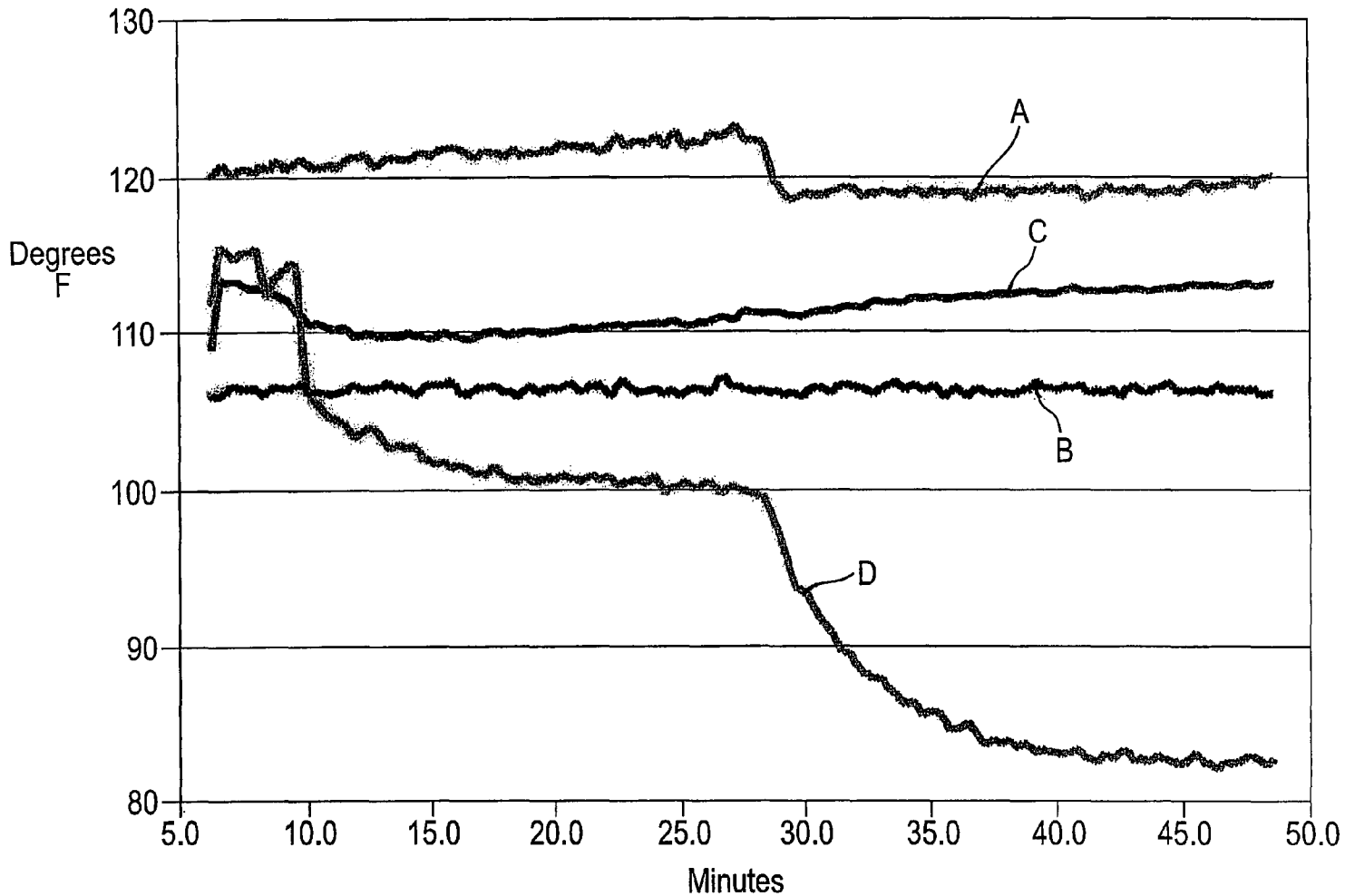
FIG. 15 is a graph of temperature verses time, showing the increased cooling power of the fan-assisted cooling device of FIGS. 13-14.

The increased cooling power of an evaporative cooling device according to the present invention that is fan-assisted is illustrated in FIG. 15 in which, as in FIG. 11, line A represents ambient temperature, line B represents the temperature in the reservoir 12, line C represents the temperature at the inlet 41 to the evaporative cooling device 40, and line D represents the temperature at the outlet 42 of the device 40. Water is passed through the device at a steady state of about 15 mL/min. Once the average temperature at the outlet 42 has reached approximately steady state (at about 25 minutes on the graph) the fan 230 is actuated, and, as can be seen, the temperature of the water at the outlet 42 falls further by a significant amount.

The evaporative cooling device 40 as hereinbefore described is thus adapted to be fitted in-line in an hydration system of the kind comprising a reservoir 12 and a drinking tube 32 to cool drinking water or other potable liquids to a temperature of at least about 15° C. (25° F.) below ambient temperature, whilst providing such cooled water or liquids at a rate of up to about 500-1000 mL per hour, which may be delivered intermittently, for example in doses of about 50-150 mL approximately every 10-12 minutes. If additional cooling power is required, then the evaporative cooling device may be fan-assisted.

Further, the evaporative cooling device 40 of the invention may be used for cooling water or other liquid to be distributed around a specially adapted garment 160, such as a jacket or vest, which includes integrant channels or tubes 162 for directing the cooled water or liquid around the garment in proximity to the wearer's body in order to effect a cooling of the wearer.

The invention claimed is:

1. A cooling garment incorporating a supply of cooled drinking liquid, said garment comprising:

a garment portion that is adapted to be worn by a user, said garment portion incorporating integrant channels for conveying cooled liquid through at least part of said garment portion for cooling the user, said integrant channels having an inlet port and an outlet port;

a reservoir that is adapted to contain a supply of liquid;

an evaporative cooling device that is arranged to receive water from said reservoir and from the outlet port of said garment portion and to deliver cooled liquid to the inlet port of said garment portion and to a separate outlet for providing cooled liquid for drinking, the evaporative cooling device having:

a vessel adapted to receive the liquid, said vessel comprising a vessel wall, an outer layer of absorbent material that extends at least partially over said vessel wall, and a wick extending through said vessel wall, such that said wick is positioned to contact said liquid within the vessel and is adapted to transport a portion of said liquid through the wall by capillary action to said absorbent material, said wick being substantially impermeable to gas or vapor; the arrangement being such that liquid transported from within the vessel to the outer layer by said wick is absorbed by the absorbent material, from which it evaporates, the heat required for such evaporation being removed from the liquid disposed within the vessel through the vessel wall, thereby cooling such liquid.

2. The cooling garment according to claim 1, wherein said liquid circulates through said integrant channels and said evaporative cooling device by one of thermal siphoning and action of a pump.

3. The cooling garment according to claim 1, wherein said garment portion comprises one of a jacket, vest and other garment adapted to be worn over the user's upper body.

4. The cooling garment according to claim 1, wherein said vessel wall comprises a sleeve portion defining a channel that extends from within the vessel to the outside of said vessel wall, said wick being packed into said channel, the lengths of the sleeve portion and wick being such that said wick is substantially impermeable to gas or vapor.

5. The cooling garment according to claim 1, wherein said vessel comprises an outlet for withdrawing cooled liquid from the vessel and an inlet that is connected to a reservoir that is adapted to contain liquid, the arrangement being such that upon withdrawing liquid from the vessel through said outlet, the vessel is automatically replenished with liquid from said reservoir.

6. The cooling garment according to claim 1, wherein said vessel is configured such that as said liquid is withdrawn from the outlet, the liquid is constrained to flow within the vessel progressively from the inlet to the outlet.

7. The cooling garment according to claim 6, wherein said vessel comprises a plurality of chambers that are arranged between said inlet and said outlet, the liquid passing successively through said chambers as the liquid is withdrawn from the outlet.

8. The cooling garment according to as claim 7, wherein each chamber has a chamber wall that is covered at least partially by an outer layer of said absorbent material and a wick extending through said chamber wall for transporting a portion of the liquid within the chamber by capillary action to said outer layer.

9. The cooling garment according to claim 8, wherein each chamber comprises a chamber inlet port and a chamber outlet port for connecting the chamber to the chamber inlet port of the next succeeding chamber, and a plurality of baffles that are arranged within the chamber to constrain the liquid to flow progressively between said chamber inlet outlet ports along a tortuous path.

10. The evaporative cooling device claimed in claim 1, wherein said vessel comprises (i) an outlet for withdrawing cooled liquid from the vessel and (ii) an inlet that is connected to a reservoir that is adapted to contain liquid, the arrangement being such that upon withdrawing liquid from the vessel through said outlet, the vessel is automatically replenished with liquid from said reservoir.

11. The evaporative cooling device claimed in claim 10, wherein said vessel has a capacity in the range of about 100 mL to about 1500 mL.

12. The evaporative cooling device claimed in claim 1, wherein said vessel is configured such that, as said liquid is withdrawn from the outlet, the liquid is constrained to flow within the vessel progressively from the inlet to the outlet.

13. The evaporative cooling device claimed in claim 12, wherein said vessel comprises a plurality of chambers that are arranged between said inlet and said outlet, the liquid passing successively through said chambers as the liquid is withdrawn from the outlet.

14. The evaporative cooling device claimed in claim 13, wherein each chamber has (i) a chamber wall that is covered at least partially by an outer layer of said absorbent material and (ii) a wick extending through said chamber wall for transporting a portion of the liquid within the chamber by capillary action to said outer layer.

15. The evaporative cooling device claimed in claim 14, wherein each chamber comprises (i) a chamber inlet port, (ii) a chamber outlet port for connecting the chamber to the chamber inlet port of the next succeeding chamber, and (iii) a plurality of baffles that are arranged within said each chamber to constrain the liquid to flow progressively between said chamber inlet port and said chamber outlet port along a tortuous path.

16. The evaporative cooling device claimed in claim 14, wherein each chamber has a plate-like configuration, said chambers being arranged as a stack, with adjacent chambers being spaced apart to allow air to flow therebetween.

17. The evaporative cooling device claimed in claim 16, wherein said device further comprises a motorized fan for increasing the airflow over said outer layer, thereby increasing the rate at which said water or other liquid is evaporated from said absorbent material.

18. The evaporative cooling device claimed in claim 17, wherein said vessel is mounted within a hollow air-duct, and wherein said motorized fan is mounted at one end of the air-duct, thereby to cause said airflow to be ducted over said outer layer.

19. The evaporative cooling device claimed in claim 18, wherein said motorized fan is solar powered.

20. An evaporative cooling device for cooling a liquid, the device comprising:

a vessel adapted to receive liquid, said vessel comprising (i) a vessel wall and (ii) a wick extending through said vessel wall, such that said wick is positioned to contact said liquid within the vessel and is adapted to transport a portion of said liquid through the wall by capillary action, the vessel having:

an outer layer of absorbent material extending at least partially over said vessel wall; and the wick packed within a sleeve whereby the wick is arranged to transport said portion of said liquid to said absorbent material of the outer layer to allow absorption thereby, wherein lengths of the sleeve and wick are such that ambient air is not drawn into the vessel when interior pressure within the vessel is lowered relative to ambient pressure;

and wherein said wick, when packed within the sleeve and saturated with said liquid, is substantially impermeable to gas or vapor, and wherein the arrangement is such that, in use, the liquid transported from within the vessel to the outer layer by said wick is delivered to the absorbent material of the outer layer to allow evaporation therefrom, the heat required for such evaporation being removed from the liquid disposed within the vessel through the vessel wall, thereby cooling such liquid.

21. An evaporative cooling device as claimed in claim 20, wherein the liquid comprises water.

22. A cooling garment incorporating a supply of liquid, said garment comprising:

a garment portion that is adapted to be worn by a user, said garment portion incorporating integrant channels for conveying cooled liquid through at least part of said garment portion for cooling the user, said integrant channels having an inlet port and an outlet port;

a reservoir that is adapted to contain a supply of liquid;

the evaporative cooling device claimed in claim 20 that is arranged to receive liquid from said reservoir and from the outlet port of said garment portion and to deliver cooled liquid to the inlet port of said garment portion and to a separate outlet for providing cooled drinking liquid.

23. The garment claimed in claim 22, wherein the liquid comprises water.

24. The garment claimed in claim 22, wherein said liquid is caused or allowed to circulate through said integrant channels and said evaporative cooling device by at least one of (i) thermal siphoning and (ii) a pump.

25. The garment claimed in claim 24, wherein said garment portion comprises a garment adapted to be worn over the user's upper body.

* * * * *